US006309250B1

(12) United States Patent
Hyzin

(10) Patent No.: US 6,309,250 B1
(45) Date of Patent: Oct. 30, 2001

(54) COAXIAL CONNECTOR TERMINATION

(75) Inventor: Peter Joseph Hyzin, Trabuco Canyon, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/635,565

(22) Filed: Aug. 10, 2000

(51) Int. Cl.[7] ..... H01R 9/05
(52) U.S. Cl. ..... 439/578; 439/581; 439/675
(58) Field of Search ..... 439/578, 581, 439/671, 675, 580

(56) References Cited

U.S. PATENT DOCUMENTS

| | | | |
|---|---|---|---|
| 3,701,086 | 10/1972 | Somerset | 339/177 |
| 3,825,874 | 7/1974 | Peverill | 339/14 |
| 4,307,926 | 12/1981 | Smith | 339/177 |
| 4,397,516 | 8/1983 | Koren et al. | 339/177 |
| 4,688,878 | 8/1987 | Cohen et al. | 439/585 |
| 4,759,729 | 7/1988 | Kemppainen et al. | 439/580 |
| 4,799,902 | 1/1989 | Landing et al. | 439/585 |
| 4,869,690 | 9/1989 | Frear et al. | 439/675 |
| 4,976,632 | 12/1990 | Riches et al. | 439/580 |
| 5,116,244 * | 5/1992 | Cartier | 439/578 |

* cited by examiner

*Primary Examiner*—Tho D. Ta
*Assistant Examiner*—Ann McCamey
(74) *Attorney, Agent, or Firm*—Roger C. Turner

(57) ABSTRACT

Inner and outer coaxial contacts (40, 50) of a connector are connected to first and second conductors (30, 32) of a cable by first crimping the conductors to the rear ends (90, 92) of a pair of terminals (84, 86) that have pin-shaped front ends (80, 82). Then, the pin-shaped front ends of the terminals are inserted into passages (74, 76) at the rear ends of the contacts to lie in a sliding fit with the contacts. The passage at the rear end of each contact holds a clip (100, 102) forming tines (104, 106) that grasp the pin at the front of a terminal to establish good electrical contact. An insulative terminal positioner (110) has bores (112, 114) that receive the terminals to position them. The rear portion (72) of the outer contact has two laterally spaced holes (140, 76) with centers lying on opposite sides of the connector axis, a second of the holes being the second connector passage (76) that receives the second terminal pin, and the first hole receiving the rear portion of the inner contact and the inner insulator.

16 Claims, 3 Drawing Sheets

COAXIAL CONNECTOR TERMINATION

BACKGROUND OF THE INVENTION

Coaxial connectors include a center contact closest to the connector axis, a second contact that lies around and coaxial with the first contact, and possibly one or more additional contacts that lie around the second contact. One example is a cable that includes a twisted pair of wires forming cable conductors and a grounded shield around them.

A common approach for connecting the conductors of a twisted wire pair to the first and second coaxial contacts, is to form the first and second contacts with rear ends that are laterally spaced so their rear ends lie on opposite sides of the connector axis. A hole in the rear end of each contact receives a cable conductor, which is soldered or crimped in place to terminate it. One disadvantage of this approach is that the coaxial contacts may be disturbed and shifted during contact insertion and crimping or soldering, especially when the contacts are pulled out of a housing or shell for such terminations and then must be reinserted. Another disadvantage is that if the cable conductors are to be removed from a connector, this may lead to the coaxial contacts being unsuitable for reuse, as a result of crimping or of remaining solder in their holes.

The construction of the first and second contacts with their rear ends on laterally opposite sides of the connector axis, can result in a connector of large diameter. Another approach is to form a cable conductor-receiving hole at the axis of the inner contact, and to form a cable-receiving hole in the second conductor at a distance from the hole in the first conductor. This also results in a connector of large diameter. A coaxial connector of minimum diameter which avoided disturbance to the coaxial contacts during termination to the conductors of a cable and which permitted easy disconnection of the connector from the cable conductors, would be of value.

SUMMARY OF THE INVENTION

In accordance with one embodiment of the present invention, a coaxial connector is provided that effectively terminates to the conductors of a cable in a manner that avoids disturbance of the contacts during connection, which facilitates disconnection of the cable conductors from the connector, and which results in a connector of minimum width. The coaxial connector has a pair of contacts, including a first or inner contact with a mating end lying on the connector axis and including a second contact with a mating end that lies outside the first one. Each contact has a rear portion forming a passage. Each passage receives the pin-shaped front end of a terminal whose rear end is crimped to a cable conductor. The cable conductor front ends are fixed to the rear ends of the terminals as by crimping or soldering. Then, pin-shaped front ends of the terminals are inserted into the passages at the rear of the contacts. Sliding engagement of the pin-shaped front ends of the terminals with the walls of the passages in the contacts, is enabled by a clip in each passage that has tines that grip the inserted pin. The tines permit the pins to be pulled out for easy disconnection.

The second contact has a rear end with a pin-receiving passage on one side of the axis and with a larger recess on the other side of the axis. The first contact rear portion and an inner insulator, lie in the recess. This results in the passages for the two contacts both being offset from the connector axis but close to the connector axis, to produce a connector of small width.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
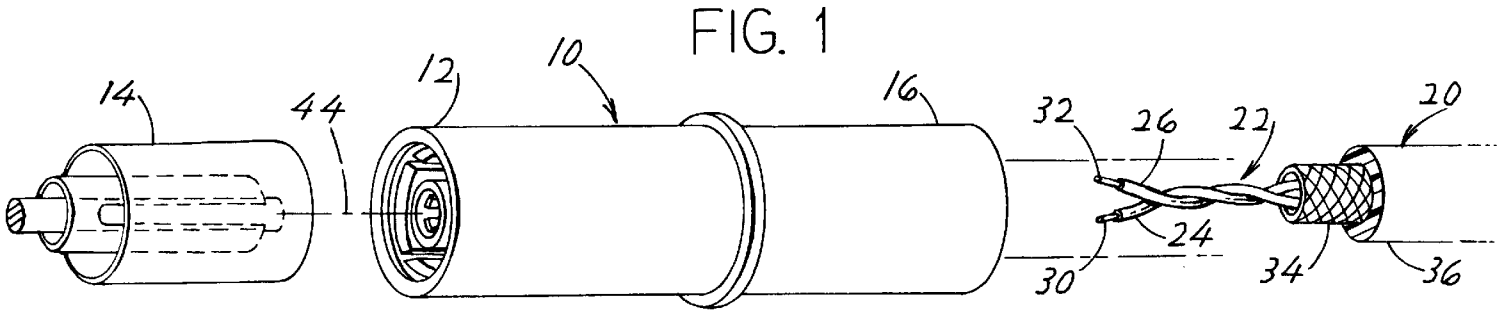
FIG. 1 is a front isometric view of a coaxial connector of the present invention, and showing a portion of a mating connector and also showing a portion of a cable that is terminated to the connector.

FIG. 1 illustrates a coaxial connector 10 which has a front mating end 12 for connection to a mating second connector 14 and a rear end 16 for termination to a cable 20. The particular cable includes a twisted wire pair 22 with first and second insulated wires 24, 26 having first and second conductors 30, 32. The cable also includes a shield 34 in the form of a metal braiding that surrounds the twisted wire pair, and a protective insulative jacket 36.

Figure 2:
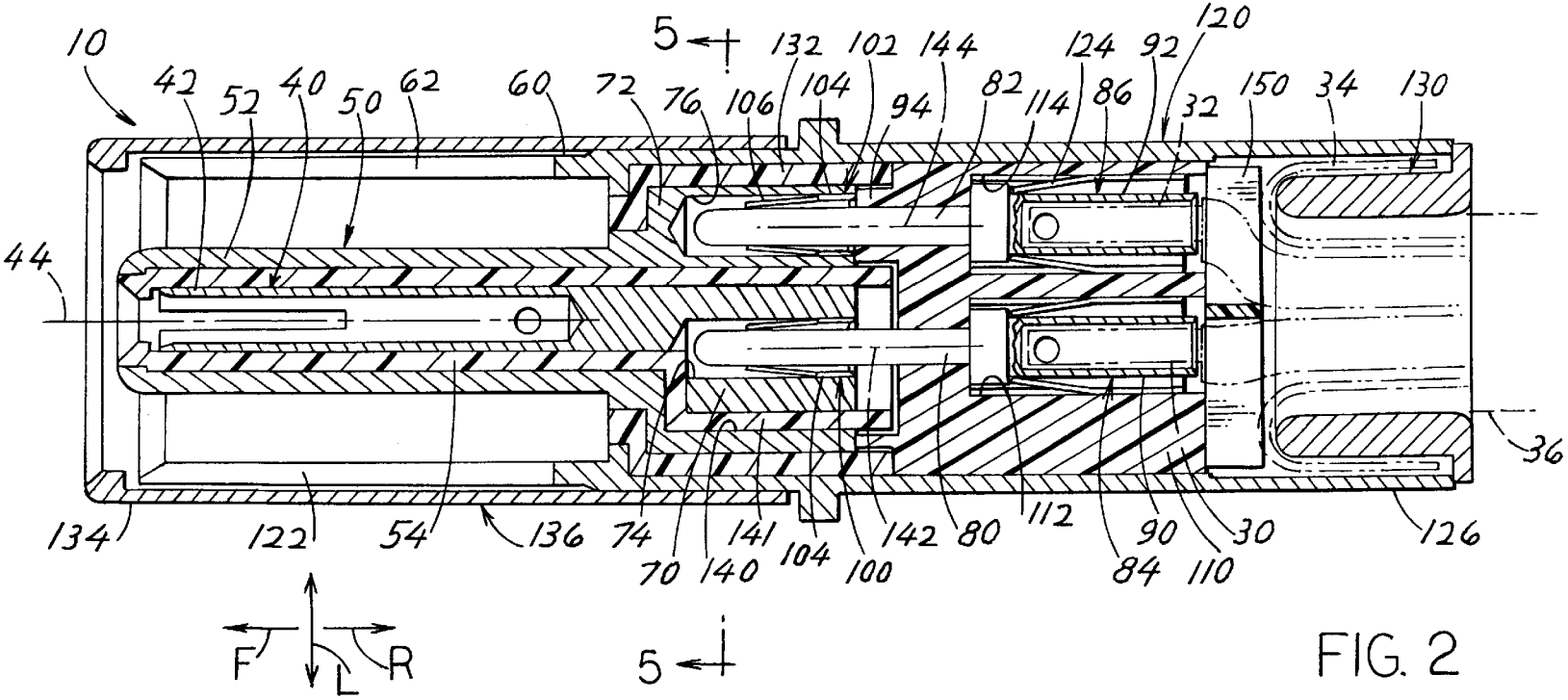
FIG. 2 is a sectional view of the coaxial connector of FIG. 1, and with the cable shown in phantom lines.
Figure 3:
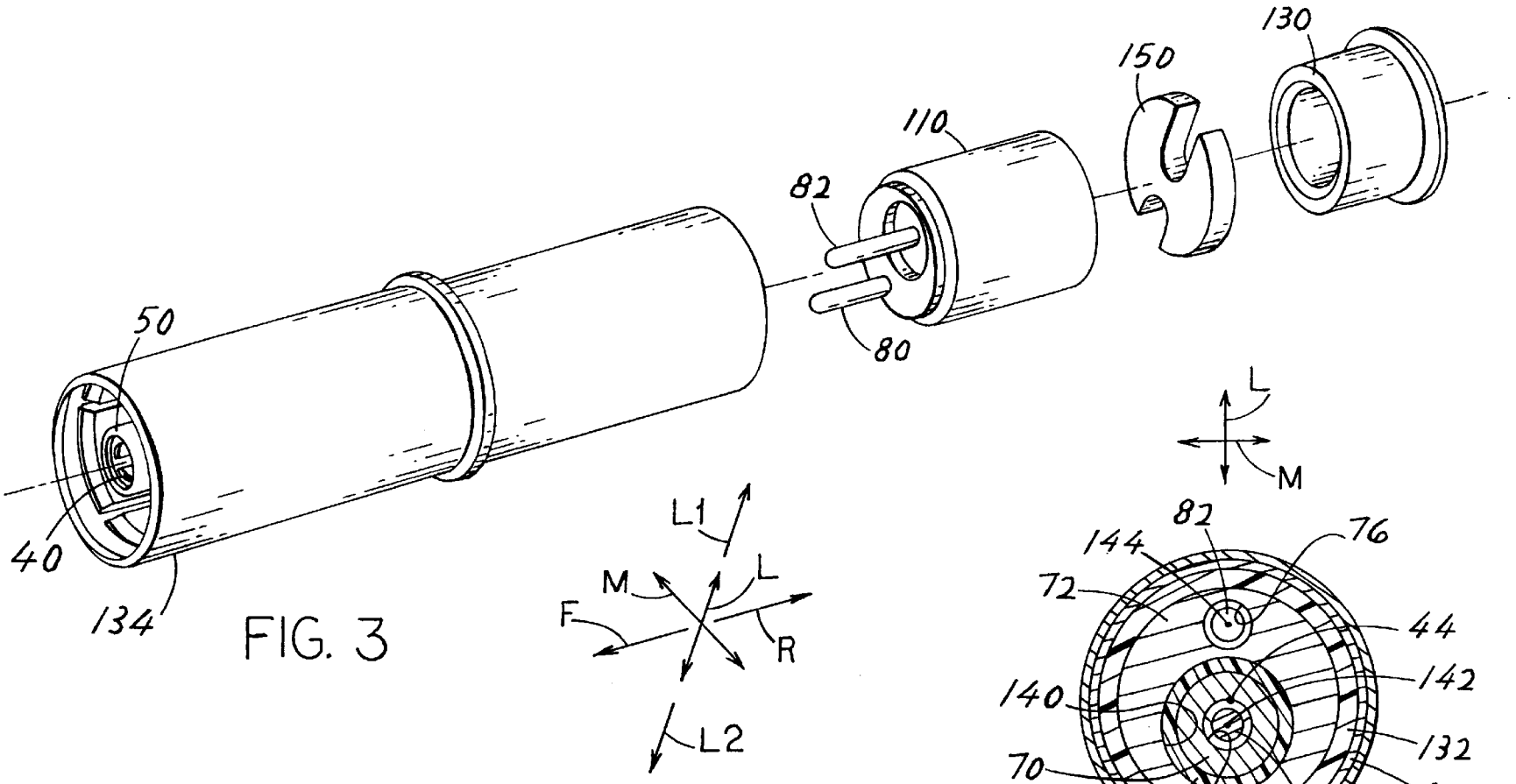
FIG. 3 is an exploded isometric view of a portion of the connector of FIG. 2, showing the portions that lie rearward of the contacts.

FIG. 2 shows that the coax connector 10 includes a first or innermost contact 40 with a mating front portion 42 lying closest to the mating axis, or connector axis 44, and a second contact 50 with a mating front end 52 lying around the first contact and spaced therefrom. An inner insulator 54 holds the first and second contacts spaced apart. The coax connector also includes a third contact 60 with a front mating end 62 lying concentric with the axis 44 but outside the first and second contacts.

The first and second contacts 40, 50 have rear portions 70, 72 with passages 74, 76 therein. The passages are designed to receive pins 80, 82 that form the front ends of first and second terminals 84, 86. Each terminal also has a rear end 90, 92 forming sleeves that can receive the cable conductors 30, 32. After the cable conductors are inserted into the sleeve-like rear ends of the terminals, they are fixed in position, preferably by crimping the terminal rear ends around the conductors. It is also possible to solder or otherwise fix the conductor front ends to the terminal rear ends while electrically connecting them together.

The cable conductors are terminated to the terminals (mechanically fixed and electrically connected), and afterward the pin-shaped front ends 80, 82 of the terminals are inserted into the passages 74, 76 of the contacts to lie in a sliding electrical connection with the contacts. Such sliding connection is assured by clips 100, 102 that lie in the passage of each contact. The combination of a contact and clip may be referred to as a contact device. Each clip has a rear portion 104 and has at least one tine and preferably a plurality of tines 106 that engage the corresponding pin 80, 82. There are no rearwardly-facing shoulders on the pins that lie forward of the tines, so the pins can be readily pulled out of the passages. Each clip is preferably formed of a the piece of sheet metal with a front portion having slots forming the tines, and with a piece of sheet metal rolled into largely a cylinder with its rear portion tending to expand against the walls of the corresponding contact passage. Instead of a clip, it is possible to form a resilient part on the contact or pin, or use other insert with a resilient part to electrically connect the pin and passage walls in sliding contact.

In order to fix the positions of the terminals 84, 86, applicant provides a terminal positioner 110 that is constructed of insulative material. The positioner has a pair of bores 112, 114 that extend in the front and rear directions F, R through the positioner. The bores have wide rear portions that receive the wide rear ends 90, 92 of the terminals, and have front ends that receive the narrower pins 80, 82 of the terminals. The front end 94 of the terminal positioner backs up clip 102 to prevent it from moving rearwardly out of its passage. Both the terminals and the terminal positioner lie within a shell 120 whose front end forms a third contact mating portion 122 which is concentric with the other contact mating portions. When the terminals are inserted forwardly into the terminal positioner, clip retainers 124 prevent rearward removal from the positioner. Thus, after the terminals are inserted into the positioner, the positioner is pushed forward to connect the terminals to the contacts.

The cable shield 34 is electrically connected to the shell 120 by first wrapping the cable shield around a ferrule 130. Prior to such wrapping, the ferrule is crimped to the jacket 36 of the cable for strain relief. The crimped ferrule 130 with the shield wrapped around it, is pressed into a rear end 126 of the shell. The rear end of the shell can be crimped around the braiding to fix it in position. An outer insulator 132 lies between the shell and the second contact 50 to position the second contact and therefore to position the first contact 40 within the shell. A protective metal cylinder 134 (which can instead be insulative) is mounted on the shell to surround the mating front portion 122 of the third contact. The combination of the outer insulator 132, shell 120, and protective cylinder 134 form an outer assembly 136 that surrounds the first and second contacts and inner insulator.

Figure 5:
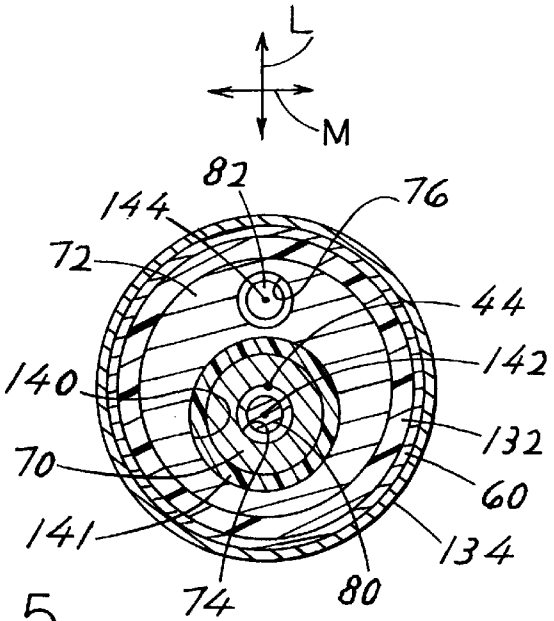
FIG. 5 is a view taken on line 5—5 of FIG. 2.
Figure 4:
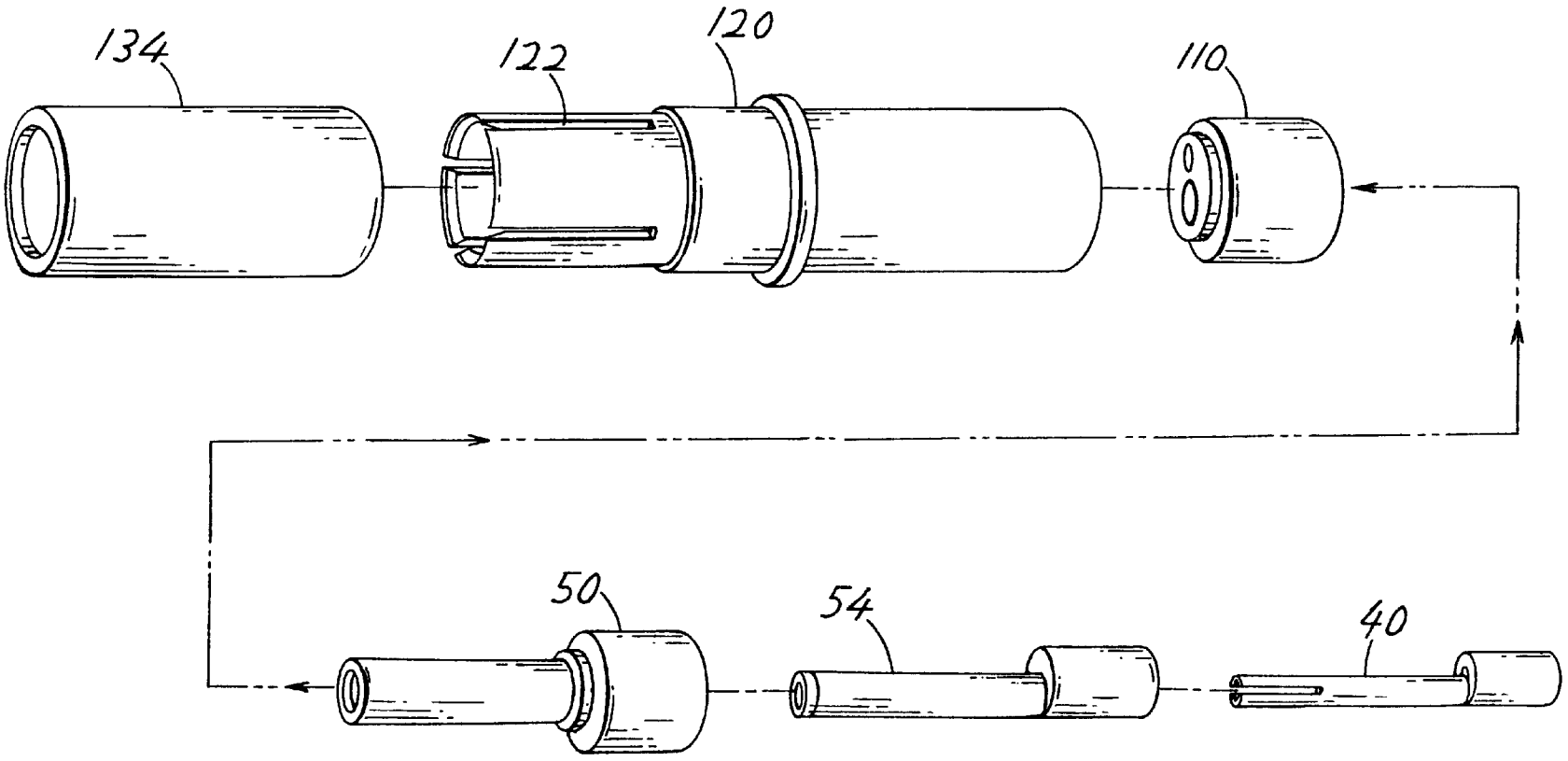
FIG. 4 is an exploded isometric view of the connector of FIG. 2.

The rear portions 70, 72 of the contacts are constructed to create a connector of minimum diameter. As shown in FIG. 5, this is accomplished by forming the rear portion of the second contact with a recess 140 that is offset (its axis is offset) from the connector axis 44. A rear portion 141 of the inner insulator 54 and the rear portion 70 of the first contact lying in the recess 140. The first contact passage 74 has an axis 142 that is offset from the connector axis 44. The passage 76 in the rear portion of the second contact has an axis 144 that lies on an opposite side of the connector axis 44 from the axis 142 of the first passage. This construction results in the rear portions of the connectors lying in a connector of minimum diameter.

FIG. 5 shows the positions of the passages 74, 76 in relation to the connector axis 44. It is conventional to provide coaxial connectors that are largely symmetric about the axes of their mating ends (with possibly a projection at one side), so the arrangement of FIG. 5 results in a connector of minimum diameter. It can be seen that the passage axes 142, 144 lie on a laterally L opposite sides of the connector axis 44, with the first connector axis 142 being closest. The direction M is perpendicular to the axis 44 and to the lateral direction.

Referring again to FIG. 2, it can be seen that clip 102 is prevented from moving rearward by the front end of the terminal positioner 110, although the passages could be formed with a slight undercut to hold the clips in position. It is also noted that a spacer 150 is provided between the rear ends of the terminals 84, 86 and the front end of the ferrule 130 to prevent their contact.

The construction indicated in FIG. 5, which results in a connector of minimum diameter, can be used where the bared front ends of the cable conductors are inserted directly into passages in the rear portions of the contacts. As discussed above, applicant prefers to use the intermediate terminals to which the bared front ends of the cable contacts are terminated, and which form pins that are inserted into the passages at the rear portions of the contacts. It should be noted that the invention is useful for simple coaxial connectors that include only two coaxial contacts, and is also useful for connectors that include more than three contacts where at least two of the contacts are coaxial contacts. It also should be noted that while the terminal front ends are pins and the contact rear ends form sockets that receive the pins, this could be reversed with the terminal front ends forming sockets and the contacts forming pins although this is not preferred.

In a coaxial connector of the construction illustrated that applicant has designed and built, the connector has an overall length between the front of the cylinder 134 and the rear of the shell 120 of 27.6 mm, and an outside diameter of the cylinder 134 of 7.21 mm. The second contact has a mating end portion 52 of a diameter of 2.87 mm, a rear portion 72 of an outside diameter of 5.33 mm, and an overall length of 14.85 mm. The first contact has a mating end portion 42 of 1.28 mm diameter, a rear portion 70 of 2.54 mm diameter, and an overall length of 14.07 mm. The insulator rear portion 141 has an outside diameter of 3.22 mm. The pin end 80, 82 of each terminal has a diameter 0.77 mm. The ferrule 130 has walls of 0.9 mm thickness. The contacts, three terminals, ferrule, shell and protective cylinder were all of copper alloy.

Thus, the invention provides a coaxial connector with at least first and second contacts having coaxial front mating ends, which facilitates termination of the contacts to conductors of a cable. Terminals are provided that each has a rear portion that terminates to a cable conductor, and a front portion that connects to a rear portion of a contact in a pin-and-socket connection, preferably with the terminal forming a pin and the contact forming a socket. The terminals are preferably installed and thereafter held in position by a terminal positioner of insulative material with bores that receive and locate the terminals. A clip with tines lying in each contact passage engages a terminal pin, while allowing the terminal pin to be pulled out. A connector of minimum diameter is achieved by forming the rear portion of the second contact with a recess that holds the inner insulator and the rear portion of the first contact that forms the first passage, with the rear portion of the second contact forming the second passage so its axis lies on a side of the connector axis which is opposite the axis of the first passage.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector for termination to a cable that has at least first and second conductors, comprising:

first and second contact devices that include first and second contacts;

said first contact has a mating front portion that lies on a mating axis, and said first contact has a rear portion;

said second contact has a mating front portion that surrounds said first contact mating front portion, and said second contact has a rear portion;

an inner insulator that separates said first and second contacts;

a pair of terminals including first and second terminals that each has a rear end fixed to one of the cable conductors and a front end, with said rear portions of said pair of contacts and said front ends of said pair of terminals being constructed so one of them forms a pair of pins and the other forms a pair of sockets constructed to each receive one of the pins, with each socket and pin lying in sliding electrical engagement with the other.

2. The connector described in claim 1 including:

at least one retainer clip that retains said terminals in engagement with said contacts, but with said at least one retainer clip being manipulatable by a tool to release the terminals so they can be slid rearwardly out of said contacts.

3. The connector described in claim 1 wherein:

each of said contact device rear ends includes a clip with a clip rear portion forming a rearwardly-facing clip shoulder and with a plurality of tines extending generally forwardly from said clip rear portion; and including an insulative termination positioner lying behind said contacts and having through bores, with said terminals lying at least partially in said bores and with said terminal front ends being in the form of pins that project into said passages and are engaged by said clips;

said termination positioner has a front end that lies in line with a first of said clips to abut said first clip in the event of rearward movement of said first clip, to prevent rearward movement of the first clip.

4. The coaxial connector described in claim 1 including said cable, wherein:

each of said conductors has a front end fixed to a corresponding one of said terminal rear portions;

each of said contact rear portions forms a passage and each of said terminal front ends forms a pin that lies in a corresponding passage.

5. The connector described in claim 1 wherein:

each of said terminal front ends is in the form of a pin, and each of said contact rear ends forms a passage that receives the corresponding pin, and each contact device includes at least one resilient tine in each passage that grasps the corresponding pin.

6. The connector described in claim 5 wherein:

each of said contact devices includes a clip forming a plurality of tines;

each of said pins has a front end that is devoid of a rearwardly facing shoulder that can engage the clip tines in the corresponding passage, so each pin can be readily pulled out of the passage.

7. A coaxial connector for termination to a cable that has first and second conductors, comprising:

a first contact device that includes a first contact with a mating front portion that is centered on a mating axis and with a rear portion, said mating front portion having a width in a lateral direction that is perpendicular to said mating axis;

a second contact device that includes a second contact with a mating front portion that is centered on said mating axis and that lies around the mating front portion of said first contact, said second contact having a rear portion;

an inner insulator that separates said first and second contacts;

said rear portion of said first contact has a first passage that is offset in a first lateral direction from said mating axis;

said rear portion of said second contact has a second passage that is offset from said mating axis in primarily a second lateral direction that is opposite to said first lateral direction;

said rear portion of said second contact has a recess that is offset in said first lateral direction from said mating axis, with said rear portion of said first contact and a portion of said inner insulator lying in said recess.

8. The connector described in claim 7 including:

first and second terminals that each has a rear end formed to terminate to one of said cable conductors and a front end forming a pin;

each of said contact devices includes a clip with tines that lies in one of said passages and engages a corresponding one of said pins.

9. The combination of a coaxial connector and a cable that has at least first and second conductors, comprising:

first and second coaxial contact devices that each includes a contact having a front mating end lying on a mating axis and that each has a rear portion forming a passage, with said mating end of said second contact lying around said mating end of said first contact;

an insulator that separates said first and second contacts;

first and second terminals that each has a rear end fixed to one of said conductors, with said terminals each having a front end forming a pin that lies detached in one of said passages and is electrically connected to the walls of the passage.

10. The combination described in claim 9, wherein:

each of said contact devices includes a clip that lies in one of said passages and that forms a plurality of tines that engage one of said pins.

11. A method for connecting each of a plurality of conductors of a cable to each of a plurality of contacts of a coaxial connector, where the contacts have front mating ends and rear portions forming passages, comprising:

inserting a bare front end of each conductor into a sleeve at the rear of each of a plurality of electrically conductive terminals that each has a front end forming a pin means, and fixing the conductor to the terminal rear;

inserting each pin means into a corresponding passage and into slideable engagement with the corresponding contact.

12. A coaxial connector for termination to a cable that has at least first and second conductors, comprising:

first and second contact devices that include first and second contacts;

said first contact has a mating front portion that lies on a mating axis, and said first contact has a rear portion;

said second contact has a mating front portion that surrounds said first contact mating front portion, and said second contact has a rear portion;

an inner insulator that separates said first and second contacts;

a pair of terminals including first and second terminals that each has a rear end for termination to one of the cable conductors and a front end, with said rear portions of said pair of contacts and said front ends of said pair of terminals being constructed so one of them forms a pair of pins and the other forms a pair of sockets constructed to each receive one of the pins, with each socket and pin lying in sliding electrical engagement with the other;

an outer assembly, with said first and second contacts fixed in position within said outer assembly, and with said outer assembly having a rear portion extending rearward of said contact rear ends;

a termination positioner lying in said outer assembly rear portion and having front and rear ends and a plurality of through bores extending between said ends;

said terminals each lies in one of said bores.

13. The connector described in claim 12 wherein:

said positioner has a clip retainer in each bore that prevents rearward movement of one of said terminals, whereby to enable terminal insertion into the connector passages by forward movement of said positioner.

14. A coaxial connector for termination to a cable that has at least first and second conductors, comprising:

first and second contact devices that include first and second contacts;

said first contact has a mating front portion that lies on a mating axis, and said first contact has a rear portion;

said second contact has a mating front portion that surrounds said first contact mating front portion, and said second contact has a rear portion;

an inner insulator that separates said first and second contacts;

a pair of terminals including first and second terminals that each has a rear end for termination to one of the cable conductors and a front end, with said rear portions of said pair of contacts and said front ends of said pair of terminals being constructed so one of them forms a pair of pins and the other forms a pair of sockets constructed to each receive one of the pins, with each socket and pin lying in sliding electrical engagement with the other;

a third contact with a mating front end that surrounds said second contact mating front end and that has a rear end connected to said cable third conductor;

said cable comprises a pair of twisted insulated wires forming said first and second conductors, a cylindrical cable shield forming said third conductor, and a jacket lying around said cable shield;

said third contact rear end forming a sleeve extending rearward of said first and second contacts; and a ferrule lying at least partially within said sleeve of said third contact rear end, said ferrule having a front end, and said ferrule being crimped to said cable jacket, said cable shield having a front portion wrapped about said ferrule and sandwiched between said third contact rear end and said ferrule.

15. A coaxial connector for termination to a cable that has at least first and second conductors, comprising:

first and second contact devices that include first and second contacts;

said first contact has a mating front portion that lies on a mating axis, and said first contact has a rear portion;

said second contact has a mating front portion that surrounds said first contact mating front portion, and said second contact has a rear portion;

an inner insulator that separates said first and second contacts;

a pair of terminals including first and second terminals that each has a rear end for termination to one of the cable conductors and a front end, with said rear portions of said pair of contacts and said front ends of said pair of terminals being constructed so one of them forms a pair of pins and the other forms a pair of sockets constructed to each receive one of the pins, with each socket and pin lying in sliding electrical engagement with the other;

said front ends of said first and second terminals form pins;

said rear portion of said first contact has a first passage with an axis that is offset in a first lateral direction from said mating axis;

said rear portion of said second contact has a second passage with an axis that is offset from said mating axis in primarily a second lateral direction that is opposite to said first lateral direction;

said rear portion of said second contact has a recess that is offset in said first lateral direction from said mating axis, with said rear portion of said first contact and a portion of said inner insulator lying in said recess.

16. The combination of a coaxial connector and a cable that has at least first and second conductors, comprising:

first and second coaxial contact devices that each includes a contact having a front mating end lying on a mating axis and that each has a rear portion forming a passage, with said mating end of said second contact lying around said mating end of said first contact;

an insulator that separates said first and second contacts;

first and second terminals that each has a rear end fixed to one of said conductors, with said terminals each having a front end forming a pin that lies in one of said passages and is electrically connected to the walls of the passage;

a termination positioner that has a pair of bores and that lies behind said contacts, with each of said terminals mounted in one of said bores.

* * * * *